US005211505A

United States Patent [19]

Ueda

[11] Patent Number: 5,211,505

[45] Date of Patent: May 18, 1993

[54] EXPANSION JOINT FOR BRIDGE STRUCTURE

[75] Inventor: Akira Ueda, Tokyo, Japan

[73] Assignee: Sho-Bond Corporation, Tokyo, Japan

[21] Appl. No.: 635,738

[22] Filed: Dec. 28, 1990

[51] Int. Cl.[5] ..... E01C 11/02; E01C 11/10; E04C 1/00; B32B 18/00

[52] U.S. Cl. ..... 404/47; 52/309.17; 428/325

[58] Field of Search ..... 404/47–49, 404/53–54; 52/309.17, 384–390; 428/325, 451

[56] References Cited

U.S. PATENT DOCUMENTS

| | | | |
|---|---|---|---|
| 2,069,899 | 2/1937 | Older | 404/54 |
| 3,368,464 | 2/1968 | Thorp et al. | 404/49 X |
| 3,595,142 | 7/1971 | Via | 404/49 |
| 4,174,993 | 11/1979 | Fujii et al. | 52/515 X |
| 4,443,578 | 4/1984 | Frier | 524/62 X |
| 4,681,786 | 7/1987 | Brown | 52/385 X |
| 4,699,540 | 10/1987 | Gibbon et al. | 404/49 |
| 4,756,952 | 7/1988 | Sasayama et al. | 428/520 X |
| 4,871,809 | 10/1989 | Szarka | 525/131 |
| 4,876,756 | 10/1989 | Yang | 404/54 |
| 4,953,335 | 9/1990 | Kawaguchi et al. | 52/384 |

FOREIGN PATENT DOCUMENTS 2323915 11/1973 Fed. Rep. of Germany .

*Primary Examiner*—Thuy M. Bui
*Assistant Examiner*—Nancy P. Connolly
*Attorney, Agent, or Firm*—Bucknam and Archer

[57] ABSTRACT

An expansion joint for bridge structure comprising a layer of composite consisted of rubber grains as the aggregates and synthetic resins with lower modulus of elasticity as the binder.

1 Claim, 1 Drawing Sheet

EXPANSION JOINT FOR BRIDGE STRUCTURE

BACKGROUND OF THE INVENTION

1. Field of the Invention

This invention relates to an expansion joint for bridges over rivers, valleys or roads, more particularly to such one that is called a seamless expansion joint.

2. Prior Art

Conventional expansion joints include a finger joint which comprises a pair of comb teeth-like steels arranged between a pair of slabs opposite to each other, with each one end thereof fixed to respective opposite ends of the slabs, and a rubber joint which comprises a rubber seal interconnecting the opposite ends of the slabs to cover the clearance or idle space therebetween, and these two kinds of expansion joints have been dominantly used. However, these two kinds of expansion joints involve such drawbacks due to discontinuity of pavement surfaces on the floor boards that provides vehicles with unfavorable running face and generates uncomfortable noise.

Accordingly, in order to overcome these drawbacks, there has recently been proposed and practically used such expansion joint that is called a seamless expansion joint. A main feature of this expansion joint resides in that a composite comprising a binder and natural aggregates is laid on such notched portions of pavements as prepared over opposite ends of a pair of slabs and that the upper face of thus laid composite is made even with those of the remaining portions of the pavements (cf. for example, Japanese Patent Laying-open No. 61-191703).

Worthy to the name, the seamless expansion joint provides a favorable influence upon the vehicle's running since the composite laid on the notched portions is made even with the surface of pavements, and generates little noise since there is no gap on the running face over the clearance.

Usually, the seamless expansion point employs a composite consisting of natural aggregates and a rubber asphalt as a binder, and the role of compression resistance against vehicle load is allotted to natural aggregates embedded in plastic materials, while the elasticity against the floor boards is performed by the binder.

However, since the rubber asphalt itself has no elasticity but a plastic nature, the layer of the composite cannot resist vehicles of heavy load to result in gradual deformation which ruins the flatness of the road surface. On the other hand, since the natural aggregates lack elasticity, the elasticity of the rubber asphalt alone does not provide the road structure with sufficient elasticity.

SUMMARY OF THE INVENTION

The object of the present invention is to provide an expansion joint that is capable of maintaining the flatness of the road surface and also fully following the expansive and contractive behavior of the slabs, with the above problems eliminated.

For attaining the above object, in the expansion joint for bridge structure according to the present invention, a layer of composite comprising rubber grains as the aggregates and synthetic resins with low modulus of elasticity as the binder is laid on notched portions of pavements over opposite ends of the slabs per se arranged opposite to each other while leaving an idle space or clearance therebetween for compensating possible expansion and contraction thereof in such manner that the upper surface of the composite layer is made even with that of the pavements.

Since the expansion joint according to the present invention constructed as above employs the layer of composite comprising the rubber grains as the aggregates and the synthetic resins of low modulus of elasticity as the binder, it is capable of keeping the flatness of the road surface, with the elastic nature of the binder providing both resisting and restoring forces against the vehicle load, and also following large expansion and constraction of the floor boards, owning to both the elasticity of the binder and the deformability of the rubber grains.

DESCRIPTION OF THE PREFERRED EMBODIMENT

Figure 1:
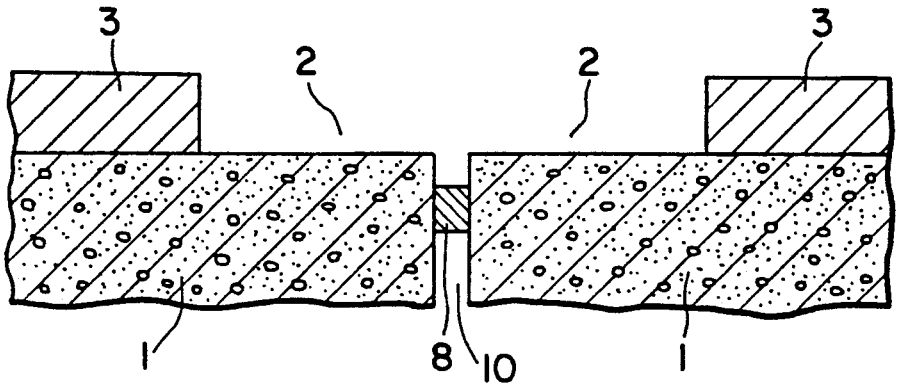
FIG. 1 a sectional view showing a state where pavement layers over opposite ends of slabs opposite to each other have been partly cut off to give notched portions.

Now, with reference to the drawings, the expansion joint of the present invention will be described in detail. Referring first to FIG. 1, notched portions 2, 2 are respectively prepared by partly cutting off end portions of pavement layers 3, 3 over slabs 1, 1 per se arranged opposite to each other while leaving some idle space or clearance 10 therebetween. A water proof member 8 is preferably charged in the clearance 10.

Figure 2:
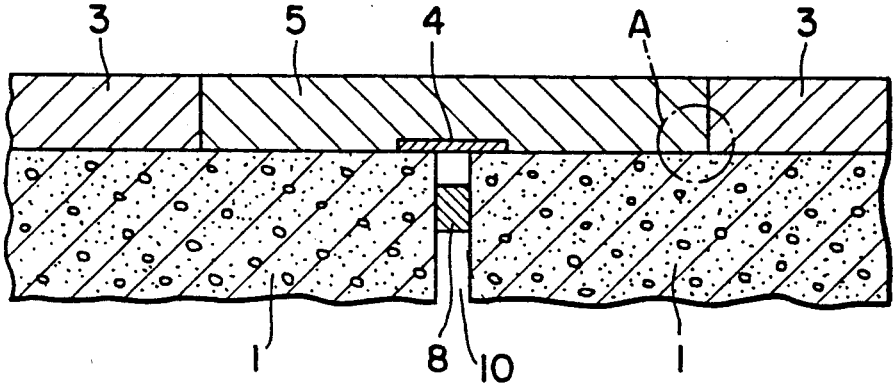
FIG. 2 is a sectional view showing another state where the expansion joint according to the present invention has been applied.
Figure 3:
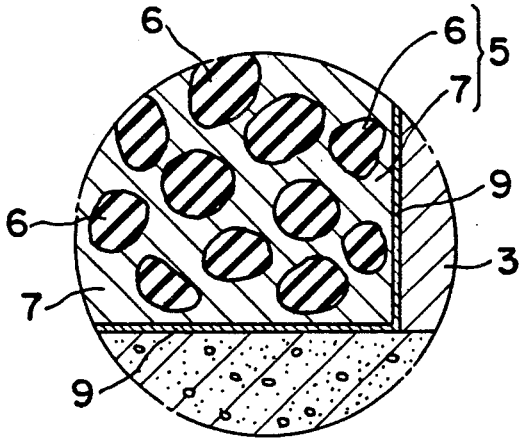
FIG. 3 is an enlarged sectional view of a portion A in FIG. 2.

Turning now to FIGS. 2 and 3, a primer 9 is preferably painted on the surface of the notched portions 2, 2, and a cover member 4 made of an aluminum plate or the like is laid over the opposite ends of the opposing slabs 1, 1 to cover them. The cover member 4 may be omitted if the composite layer 5 does not happen to drop down into the clearance 10 when laying the composite layer 5 on the floor boards 1,1. Then, the composite layer 5 comprising rubber grains 6 and a binder 7 is placed in the notched portions 2, 2 such that the upper surface may be made even with that of the pavements 3, 3.

In this embodiment, the blending rate and performance of the composite used are as follows:

Blending rate

| | |
|---|---|
| epoxy resins | 1 (by weight) |
| rubber grains (hardness 40°–60° by Shore hardness tester and grain sizes 5 mm–1 mm) | 2.5 (by weight) |

Performance

| | |
|---|---|
| compressive strength (kg/cm$^2$) | 20 |
| modulus of compression elasticity (kg/cm$^2$) | 60 |
| bending strength (kg/cm$^2$) | 14 |
| deflection (mm) | 60 |

In this connection, the deflection of a conventional composite is 3 mm, with the same volume and blending rate of 1 rubber asphalt (by weight) and 7 natural aggregates (by weight).

In comparison of these deflections, it will be apparent that the deformability of the present composite employing the rubber grains as the aggregates is very excellent.

The blending for the composite is not limited to the above mentioned but employable, as the synthetic resins of low elastic modulus, polyurethane resins, polylutadiene resins and the like which can be applied at normal temperature and posses sufficient adhesive strength. While, the rubber grains may include ethylene propylene terpolymers (EPDM), nitrile-butadiene rubbers (NBR), styrene-butadiene rubbers (SBR) and the like and the grain size preferably ranges from about 10 mm to about 1 mm. If necessary, natural aggregates may be blended thereto.

The expansion joint according to the present invention called as a whole a seamless joint is prepared as above.

Comprised as above, the expansion joint according to the present invention posseses the following effects.

Since the present seamless expansion joint is prepared using the layer of composite consisting of the aggregates of rubber grains and the binder of synthetic resins with low modulus of elasticity, the elastic nature of the low elastic modulus of synthetic resins resists againt the vehicle load and restores even though the composite layer undergoes any deformation, while the extension characteristic of the rubber grains provides sufficient shrinkage.

Further, the present seamless expansion joint also provides vehicles with good running surface and generates little noise like in the case of conventional seamless joints.

What is claimed is:

1. An expansion joint for a bridge structure having slabs comprising a layer of a composite consisting of rubber grains as the aggregates and epoxy resins with low modulus of elasticity as the binder, said layer of composite being laid on notched portions of pavements over opposite ends of said slabs per se arranged opposite to each other while leaving a clearance therebetween for compensating possible expansion and contraction of said bridge structure, said composite comprising 1 part and 2.5 parts by weight respectively of said epoxy resins and said rubber grains, said rubber grains having 40°–60° Shore hardness and grain size 5 mm–1 mm and exhibiting a compressive strength of 20 $Kg/cm^2$, a modulus of compression elasticity of 60 $Kg/cm^2$ and a deflection of 60 mm, whereby the upper surface of the composite layer is made even with that of the pavements.

* * * * *